United States Patent [19]

Bennett

[11] 4,227,627

[45] Oct. 14, 1980

[54] TRIMMER ARRANGEMENT FOR FILLING UNIT OF AUTOMATIC FILLING MACHINE

[75] Inventor: Richard N. Bennett, Arbutus, Md.

[73] Assignee: National Instrument Company, Inc., Baltimore, Md.

[21] Appl. No.: 950,286

[22] Filed: Oct. 11, 1978

[51] Int. Cl.² ..... G01F 11/02

[52] U.S. Cl. ..... 222/282; 222/309; 92/13; 92/117 A

[58] Field of Search ..... 222/309, 282, 283, 250, 222/340; 92/13, 13.4, 117 A

[56] References Cited

U.S. PATENT DOCUMENTS

| | | | |
|---|---|---|---|
| 2,807,213 | 9/1957 | Rosen | 92/5 R |
| 3,212,676 | 10/1965 | Trumbull et al. | 222/283 X |

*Primary Examiner*—F. J. Bartuska

*Attorney, Agent, or Firm*—Craig & Antonelli

[57] ABSTRACT

A volume-adjusting mechanism for a filling machine adapted to fill a number of containers with a predetermined amount of a product from a corresponding number of filling units; to enable a volume adjustment while the machine is running, the part of the filling unit normally connected with a relatively fixed part of the filling machine includes a selectively adjustable lost motion volume-adjusting mechanism to permit adjustment of the suction and discharge stroke of the filling unit.

14 Claims, 3 Drawing Figures

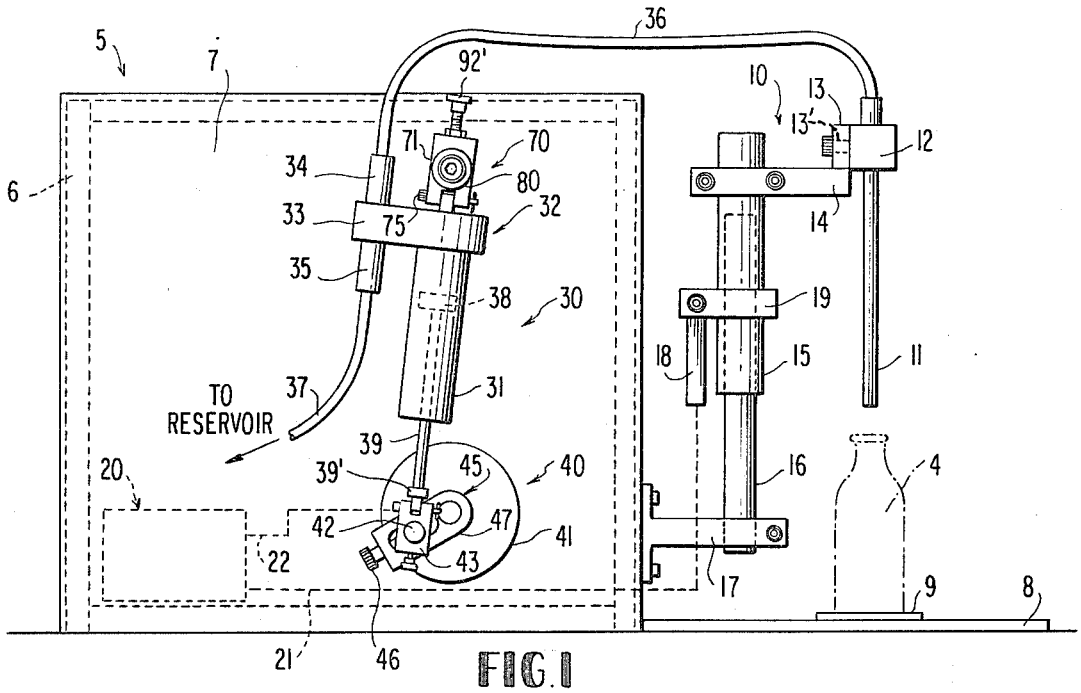
FIG. 1
FIG. 2
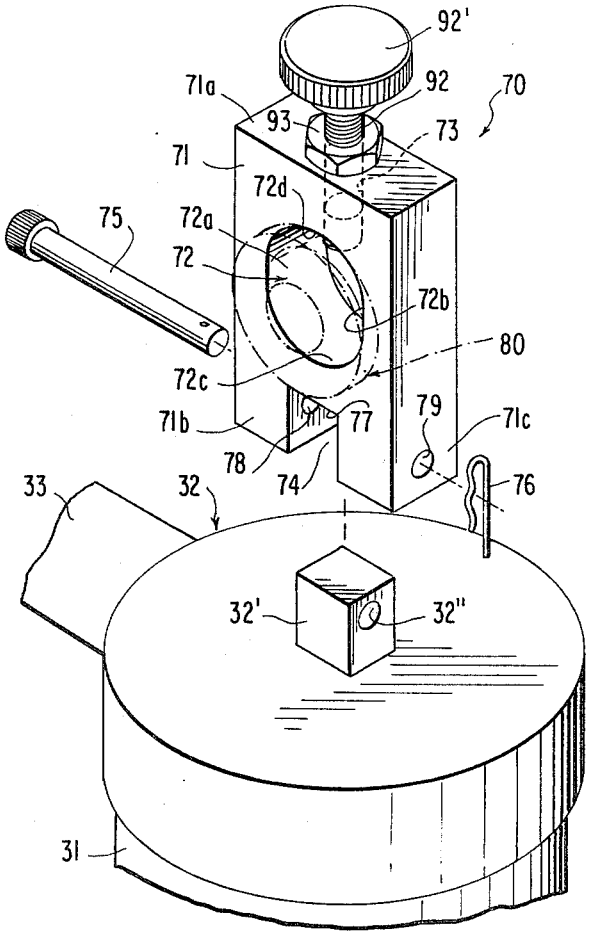
FIG. 3
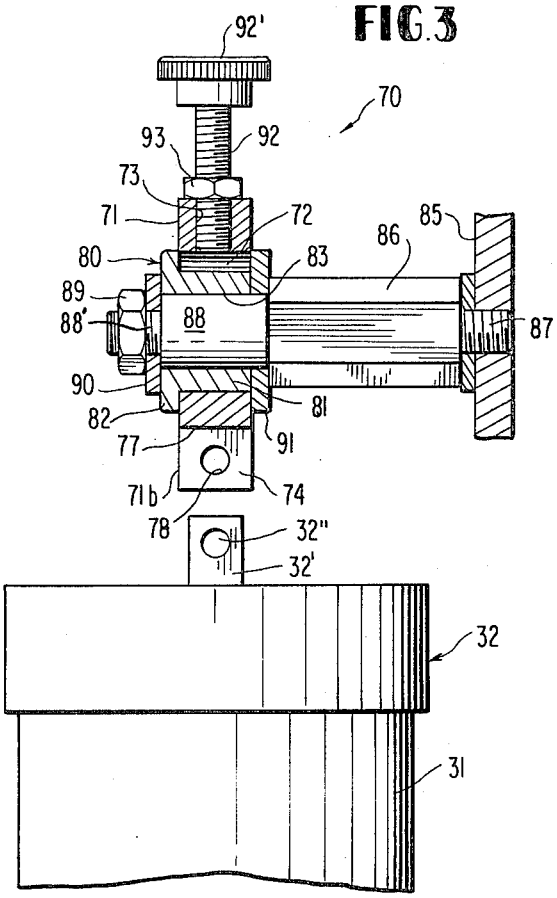

TRIMMER ARRANGEMENT FOR FILLING UNIT OF AUTOMATIC FILLING MACHINE

The present invention relates to a high-speed filling machine for filling one or several containers with a predetermined amount of a product, and more particularly to an adjusting mechanism for varying the amount to be dispensed by a respective filling unit into the container connected with the filling unit.

Filling machines of the type to which the present invention relates are known as such in the prior art (U.S. Pat. Nos. 2,807,213 and 2,907,614). In these prior art filling machines, the filling units consisting of a cylinder and piston reciprocating within the cylinder were driven by an eccentric drive arrangement, whereby the eccentric pin was operatively connected with the free end of the piston rod in such a manner as to allow for a change in the pump stroke and therewith in the amount of the produce to be dispensed by a given filling unit. For this purpose, the prior art eccentric drives included an adjusting mechanism to vary the amount of eccentricity between the eccentric drive pin and the axis of rotation of the disk-like driving member carrying the drive pin by the use of a lead screw assembly, as more fully disclosed in the aforementioned U.S. Pat. Nos. 2,807,213 and 2,907,614. While this arrangement proved satisfactory in actual operation for many years, it nevertheless entailed a number of disadvantages. First of all, since the prior art adjusting mechanism for changing the volume of the pump stroke was part of and connected with the rotating disk-like member, any adjustment in the volume of the product to be discharged into the container or containers required a stoppage of the entire filling machine. This drawback became ever more significant as the requirement to improve the overall efficiency of the filling machines became increasingly important, i.e., as the need to increase the speed and to reduce any downtime of the filling machine became ever more important. Moreover, the prior art volume-adjusting mechanisms were relatively complicated in structure thereby increasing the cost of the machine. Additionally, since the adjusting mechanism involved moving parts, subjected to rotation while the machine was operating, the parts of the adjusting mechanism had to be constructed correspondingly strong to be able to withstand the occurring stresses. Finally, when more than one filling unit were operated from a given eccentric drive as disclosed, for example, in the U.S. Pat. No. 4,077,441, the prior art adjusting mechanisms did not permit individual trimming adjustments of the individual filling units to compensate for minor operating differences therebetween.

It is the aim of the present invention to avoid the aforementioned shortcomings and drawbacks encountered in the prior art and to provide a volume-adjusting mechanism for filling machines of the type described above which permits a selective adjustment in the volume of the product to be dispensed by a given filling unit while the machine continues in operation.

The underlying problems are solved according to the present invention in that the volume-adjusting mechanism of the instant invention is incorporated into the connection between the cylinder assembly of the filling unit and the relatively fixed part of the filling machine, thereby obviating the need for stopping the machine when making a volume adjustment. In one preferred embodiment of the present invention, the volume-adjusting mechanism includes a means for selectively varying the lost motion between the relatively fixed part and the cylinder of the filling unit during the suction and discharge strokes. In a particularly simple construction of the adjusting mechanism according to the present invention, the end cover assembly of the cylinder is pivotally connected with a swivel member, provided with a longitudinal slot, within which a bearing member, secured to a relatively fixed part, is able to slide to and fro corresponding to the given lost motion. The extent of the to and fro sliding movement, i.e., the extent of the lost motion is adjustable by means of a threaded adjusting member adapted to be screwed in or out of a threaded bore provided in the swivel member and extending in the direction of the longitudinal axis of the elongated slot. To retain the parts in their assembled position, the bearing member is provided with a collar portion of a diametric dimension greater than the width of the slot and is assembled to the relatively fixed part in such a manner that the swivel member is arranged between the collar portion of the bearing member and the relatively fixed part.

The amount of lost motion is determined by merely screwing the adjusting member more or less into the elongated slot, whereby the maximum stroke of the filling unit is achieved with zero lost motion while the minimum stroke of the filling unit is realized with maximum lost motion when the bearing member is able to slide the full length of the slot.

The present invention is particularly useful in connection with filling machines of the type disclosed in the U.S. Pat. No. 4,077,441 since it permits in that case an individual trimmer adjustment of the filling unit, whose swivel member is suitably secured to an upper pump post mounting bar.

Accordingly, it is an object of the present invention to provide a filling machine equipped with an adjusting mechanism which avoids by simple means the aforementioned shortcomings and drawbacks encountered in the prior art.

Another object of the present invention resides in an adjusting mechanism for high speed filling machines which permits adjustment of the individual filling unit or units during the operation of the machine.

A further object of the present invention resides in an adjusting mechanism for filling machines of the type described above which is simple in construction as well as reliable in operation, yet requires only relatively few parts which can be readily machined and assembled.

Still a further object of the present invention resides in a filling machine equipped with a volume-adjusting mechanism which permits a simple, yet highly accurate adjustment of the amount of the product to be metered by a given filling unit in an extremely simple manner without requiring any special skills.

Another object of the present invention resides in an adjusting mechanism for filling units of high-speed filling machines which is accurate and also assures a long service life without requiring premature replacement of parts.

These and other objects, features and advantages of the present invention will become more apparent from the following description when taken in connection with the accompanying drawing which shows, for purposes of illustration only, one embodiment in accordance with the present invention, and wherein:

FIG. 1 is a somewhat schematic, side elevational view of a filling machine equipped with an adjusting mechanism for the filling unit thereof in accordance with the present invention;

FIG. 2 is a perspective exploded view, on an enlarged scale, of the parts of the adjusting mechanism for a filling unit in accordance with the present invention; and FIG. 3 is a cross-sectional view taken along line III—III of FIG. 2.

Referring now to the drawing, wherein like reference numerals are used throughout the various views to designate like parts, and more particularly to FIG. 1, the filling machine generally designated therein by reference numeral 5 is of any conventional construction and includes a suitable frame schematically indicated by reference numeral 6, over which are mounted sheet-metal housing panels, of which only housing panel 7 is shown. FIG. 1 additionally illustrates a conveyor support 8 fixed on the machine and supporting thereon an endless conveyor 9.

The reciprocating nozzle support assembly generally designated by reference numeral 10 for bottom-fill operation includes one or several filling nozzles 11, each retained in a nozzle holder 12, adjustably secured in a nozzle bracket 13 which is provided for that purpose with an elongated slot 13'; the nozzle bracket 13 itself is threadably secured to the nozzle bar support 14. A guide post 16 is suitably secured to the frame 6 by way of a guide post support 17. The nozzle bar support 14 is suitably clamped fast onto a nozzle bar guide sleeve 15, adapted to reciprocate on guide post 16. An actuating linkage bar 18 is secured to the guide sleeve 15 by way of a clamping collar 19; the reciprocation for bottom fill operation of the nozzle support assembly 10 is obtained from a conventional clutch and brake motor generally designated by reference numeral 20 by way of a drive and actuating connection schematically indicated by reference numeral 21.

The filling unit generally designated by reference numeral 30 consists of a cylinder 31, of a piston 38 with piston rod 39 reciprocating in cylinder 31 and of a cylinder end cover assembly 32 closing off the cylinder 31 and including a laterally projecting valve housing 33 connected with a discharge valve housing section 34 and a suction valve housing section 35. A discharge line 36 leads from the discharge valve housing section 34 to a respective nozzle 11. A suction line 37 leads to a reservoir of the product to be filled into the containers 4 carried on the endless conveyor 9. To cause the piston 38 supported on the piston rod 39 to reciprocate within the cylinder 31, the free end of the piston rod 39 is operatively connected with a piston actuating mechanism generally designated by reference numeral 40 which includes a rotating disk-like driving member 41, also driven from the clutch and brake motor 20 by way of a drive connection schematically indicated by reference numeral 22. The disk-like driving member 41 carries an eccentric pin 42 operatively connected with the lower swivel member 43 which itself is pivotally connected with the connecting member 39' secured to the free end of the piston rod 39. To provide a change in volume of the product dispensed by the filling unit 30 into a container 4, a volume-control device generally designated by reference numeral 45 was provided in the prior art (U.S. Pat. No. 2,807,213) which consisted of a lead-screw assembly including an adjusting body 47 and an adjusting knob 46 causing a change in the eccentricity of the pin 42 upon rotation thereof. The various parts of the filling machine described so far are of conventional construction, for example, as disclosed in the U.S. Pat. No. 2,807,213, in the U.S. Pat. No. 2,978,149 or in the U.S. Pat. No. 2,907,614. Of course, a suitable indexing mechanism is also provided with the filling machine to hold the containers stationary during the filling operation. Again, any conventional indexing mechanism may be utilized for that purpose, for example, as disclosed in the U.S. Pat. No. 3,067,786, in the U.S. Pat. No. 3,237,661 or in the U.S. Pat. No. 4,083,389. Moreover, the filling machine may be of any known type utilizing one or several nozzles whereby one filling unit 30 each is provided for a respective nozzle.

Whereas the volume-adjusting mechanisms of the type shown and designated herein by reference numerals 45, 46, 47, which corresponds to those disclosed, for example, in the U.S. Pat. Nos. 2,807,213; 2,907,614; and 2,978,149, were interposed between the rotating disk member 41 and the swivel member 43 pivotally connected to the free end of the piston rod 39, thereby necessitating a stopping of the machine for purposes of making a volume adjustment, the present invention utilizes a volume-adjusting mechanism interposed between the cylinder end cover assembly 32 and a relatively fixed part of the machine in such a manner that the volume adjustment can be made for each filling unit also while the machine continues to run. More specifically, the volume-adjusting mechanism according to the present invention, generally designated by reference numeral 70 in FIGS. 1, 2 and 3, includes an upper swivel member 71 of generally rectangular configuration which is provided with a longitudinal slot 72 of predetermined width. The slot 72 is defined by straight longitudinal side portions 72*a* and 72*b* and by semi-cylindrical end surfaces 72*c* and 72*d*. Additionally, the upper swivel member 71 is provided with a threaded bore 73 that extends in the longitudinal direction of the slot 72 substantially coaxially therewith from the upper end surface 71*a* of the upper swivel member 71 into the slot 72. The opposite end of the upper swivel member 71 is provided with a cut-out 74 forming a rectangular notch defined by the mutually facing surfaces of the leg portions 71*b* and 71*c* and the bottom surface 77. A bore 78 extends through the leg portion 71*b* while a bore 79 extends through the leg portion 71*c*. The end cover assembly 32 is provided with a connecting portion 32' of a configuration essentially complementary to the notch 74 but of a height less than the depth of the notch to permit assembly of the cylinder end cover assembly 32 onto the swivel member 71 by the use of a connecting pin 75 extending through bores 78 and 79 as well as through a bore 32" in the projection 32'. A cotter pin schematically indicated in FIG. 2 and designated by reference numeral 76 may be used to hold the pin 75 in the assembled condition.

The adjusting mechanism 70 according to the present invention further comprises a bearing member generally designated by reference numeral 80 (FIG. 3) which consists of a cylindrical bearing portion 81 of a diametric dimension complementary to but slightly less than the width of the slot 72 and of a collar portion 82 which is larger in diametric dimension than the width of slot 72. Additionally, the bearing member 80 is provided with a coaxial bore 83 extending centrally thereof. A relatively fixed part 85 (FIG. 3) which may be any suitable, relatively fixed part of the machine, serves to support the volume-adjusting mechanism of the present invention on the filling machine. For that purpose, an upper pump post 86, for example, of hexagonal configuration, is used which with its right threaded end portion 87 is screwed into the relatively fixed part 85. Opposite the threaded end portion 87, the upper pump post 86 is provided with a bearing portion 88 terminating near the free end thereof in a threaded portion 88'. The bearing portion 88 is of such diametric dimension as to engage into the bore 83 of the bearing member 80 and thereby supports the latter. A fastening nut 89 is screwed onto the threaded end portion 88', possibly by the interposition of a washer 90. A similar washer 91 may be interposed between the pump post 86 and the bearing member 80. As can be seen from FIG. 3, with the collar portion 82 larger than the width of the slot 72, the bearing member 80 and therewith the swivel member 71 is held in place in the axial direction of the pump post 86 relative to the fixed part 85. A threaded adjusting member 92 (FIG. 2) with a knurled knob portion 92' is adapted to be screwed into and out of the threaded bore 73. The position of the adjusting member 92, 92' may be fixed by a lock nut 93.

In operation, the maximum pump stroke of the filling unit 30 is realized when the adjusting screw 92 is screwed so far into the slot 72 that the bearing portion 81 of the bearing member 80 essentially engages with the curved end surface **72*c*. Under these circumstances, no lost motion exists between the parts 32, 32'' and 71, on the one hand, and parts 80, 86, 88 and 85, on the other, during actuation of the filling unit 30 as a result of the rotation of the eccentric pin 42. On the other hand, the minimum pump stroke is realized if the adjusting screw 92 is screwed out of the threaded bore 73 to such an extent that the bearing portion 81 of the bearing member 80 is able to travel the full length of the slot 72. Under those conditions, assuming that the piston 38 nears the upper dead-center position of the discharge stroke, the bearing portion 81 is in engagement at that time with the cylindrical end surface 72*d*. As the suction stroke now begins, the bearing portion 81 will now pass through the lost motion corresponding to its travel from engagement with the end surface 72*d* into engagement with the end surface 72*c*, so that the maximum lost motion correspondingly reduces the suction stroke of the cylinder-piston assembly of the filling unit 30. Similarly, at the beginning of the discharge stroke, the bearing portion 81 will again go through the lost motion by travelling from its engagement with the end surface 72*c* into engagement with the end surface 72*d*. Of course, any intermediate position of the adjusting screw 92** will correspondingly change the lost motion and therewith the effective length of the stroke of the piston in the cylinder of the filling unit.

It can thus be seen that the adjusting mechanism 70 of the present invention provides for a fine, highly accurate adjustment of the volume metered by a respective filling unit. The adjusting mechanism of the present invention may be utilized in lieu of the lead screw adjusting mechanism 45, 46, 47, as disclosed in the aforementioned U.S. Pat. No. 2,807,213, or may be utilized in addition thereto to provide for a trimmer adjustment during the operation of the machine. This is particularly important when several filling units are driven in unison from a common drive member, as, for example, disclosed in the aforementioned U.S. Pat. No. 4,077,441.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A volume-adjusting mechanism for a filling machine operable to fill containers with a predetermined amount of a product and comprising at least one filling unit having at least two parts movable relative to one another and including pump cylinder and piston means, actuating means operatively connected with one of said parts to cause relative movement between said parts and thereby provide a suction and discharge stroke for a respective filling unit, and the other part being adapted to be connected with a relatively fixed part of the filling machine, characterized by volume-adjusting means external of said other part for operatively connecting said other part with said relatively fixed part to enable a change in the volume of the product to be sucked-in and discharged by a respective filling unit by changing the physical location of the effective connection of said other part with respect to the fixed part without change in the volume of the pump cylinder means.

2. A volume-adjusting mechanism for a filling machine operable to fill containers with a predetermined amount of a product and comprising at least one filling unit having at least two parts movable relative to one another and including pump cylinder and piston means, actuating means operatively connected with one of said parts to cause relative movement between said parts and thereby provide a suction and discharge stroke for a respective filling unit, and the other part being adapted to be connected with a relatively fixed part of the filling machine, characterized by volume-adjusting means operatively connecting said other part with said relatively fixed part to enable a change in the volume of the product to be sucked-in and discharged by a respective filling unit, the volume-adjusting means including adjustable lost-motion means to selectively vary the lost motion between said other part and said relatively fixed part during the suction and discharge stroke of the filling unit.

3. A volume-adjusting mechanism according to claim 2, characterized in that the adjustable lost motion means includes a swivel member provided with an elongated slot, a bearing member having a bearing portion of a width substantially complementary to the width of the slot to enable free sliding movement of the bearing portion within said slot, and means for selectively limiting the free sliding movement of said bearing portion in said slot.

4. A volume-adjusting mechanism according to claim 3, characterized in that said limiting means includes a threaded adjusting member extending longitudinally into the slot and adapted to be selectively screwed-in or out of a threaded bore provided in said swivel member at least approximately coaxially with the longitudinal direction of said slot.

5. A volume-adjusting mechanism according to claim 4, characterized in that said swivel member is pivotally connected with said other part about a pivot axis extending substantially at right angle to the longitudinal direction of said slot.

6. A volume-adjusting mechanism according to claim 5, characterized in that the bearing portion of said bearing member is of cylindrical configuration with the outside diameter complementary to but slightly smaller than the width of said slot.

7. A volume-adjusting mechanism according to claim 6, characterized in that said bearing member includes a collar portion of a diameter larger than the width of said slot and is operatively connected with said relatively fixed part in such a manner that said swivel member is disposed between said collar portion and said relatively fixed part.

8. A volume-adjusting mechanism according to claim 7, characterized in that said one part includes a piston whose piston rod is operatively connected with an eccentric drive means forming part of the actuating means while the other part forms part of the cylinder means.

9. A volume-adjusting mechanism according to claim 8, characterized in that the eccentric drive means is devoid of volume-adjusting means.

10. A volume-adjusting mechanism according to claim 3, characterized in that said swivel member is pivotally connected with said other part about a pivot axis extending substantially at right angle to the longitudinal direction of said slot.

11. A volume-adjusting mechanism according to claim 3, characterized in that the bearing portion of said bearing member is of cylindrical configuration with the outside diameter complementary to but slightly smaller than the width of said slot.

12. A volume-adjusting mechanism according to claim 3, characterized in that said bearing member includes a collar portion of a diameter larger than the width of said slot and is operatively connected with said relatively fixed part in such a manner that said swivel member is disposed between said collar portion and said relatively fixed part.

13. A volume-adjusting mechanism according to claim 12, characterized in that the bearing portion of said bearing member is of cylindrical configuration with the outside diameter complementary to but slightly smaller than the width of said slot.

14. A volume-adjusting mechanism for a filling machine operable to fill containers with a predetermined amount of a product, comprising at least one filling unit including pump cylinder means and piston means carried by a piston rod and operable to reciprocate within said pump cylinder means, actuating means including an eccentric drive means operatively connected with said piston rod to cause relative movement between said pump cylinder and piston means and thereby provide a suction and discharge stroke for a respective filling unit, and volume-adjusting means external of said pump cylinder means for operatively connecting said pump cylinder means with a relatively fixed part of the filling machine to thereby enable a change in the volume of the product to be sucked-in and discharged by a respective filling unit by changing the physical location of the effective connection of said cylinder means with respect to said fixed part and thereby change the effective stroke of the piston means relative to the cylinder means without changing the stroke of the piston means relative to said filling machine.

* * * * *